US006817612B1

(12) United States Patent
Coleman

(10) Patent No.: US 6,817,612 B1
(45) Date of Patent: Nov. 16, 2004

(54) DIE RICH

(75) Inventor: Kenneth Ross Coleman, Reno, NV (US)

(73) Assignee: Kenneth R. Coleman, Reno, NV (US)

( * ) Notice: Subject to any disclaimer, the term of this patent is extended or adjusted under 35 U.S.C. 154(b) by 0 days.

(21) Appl. No.: 10/708,716

(22) Filed: Mar. 19, 2004

(51) Int. Cl.[7] ..... A63F 9/04

(52) U.S. Cl. ..... 273/146; 273/274; 273/292; 273/309

(58) Field of Search ..... 273/146, 292, 273/274, 309

(56) References Cited

U.S. PATENT DOCUMENTS 3,989,254 A * 11/1976 Cooper ..... 273/262
4,260,158 A * 4/1981 Lohn ..... 273/267
4,410,182 A * 10/1983 Francis ..... 273/268
4,573,688 A * 3/1986 Grimes ..... 273/241
4,711,453 A * 12/1987 Saint Ive ..... 273/268
4,900,034 A * 2/1990 Bereuter ..... 273/274
5,042,816 A * 8/1991 Davis et al. ..... 273/243
5,431,407 A * 7/1995 Hofberg et al. ..... 273/292
5,575,161 A * 11/1996 Hinchey ..... 63/33
5,758,878 A * 6/1998 Brown ..... 273/274
5,782,472 A * 7/1998 Brown ..... 273/274
5,806,847 A * 9/1998 White et al. ..... 273/309
5,961,119 A * 10/1999 Brown ..... 273/292
6,257,579 B1 * 7/2001 Horan ..... 273/274
6,273,423 B1 * 8/2001 Promutico ..... 273/274
6,508,469 B2 * 1/2003 Promutico ..... 273/274
6,520,503 B1 * 2/2003 Porto ..... 273/274
6,554,281 B2 * 4/2003 Flannery ..... 273/274

* cited by examiner

*Primary Examiner*—Derris H. Banks
*Assistant Examiner*—D Collins

(57) ABSTRACT

A game using one die, a dice cup, a point marker, and a game board is disclosed. The game is similar to Craps. There is a come-out roll. If a six is rolled the player is paid, if a one is rolled the player loses. Any other number becomes the point. Three chances are given to roll the point again. If the point is rolled on the first opportunity, the player is paid two-to-one. If the point is rolled on the second or third opportunity, the player is paid one-to-one. If the point is not rolled in three tries, the player loses. If a one is rolled while trying to roll the point, the player also loses.

4 Claims, 2 Drawing Sheets

DIE RICH

BACKGROUND OF INVENTION

There is need for new casino games. This game's advantages include its simplicity, its similarity to the game of craps, and the complete control of the die by the house.

1. Field of the Invention

The present invention relates generally to games and particularly to games of chance involving the throwing of a die.

2. Description of the Related Art

Throughout history the six-sided cubes called dice have been used in many types of games. Most commonly the six sides of a die are numbered one through six, although other symbols have appeared depending upon the game. The present invention utilizes a single die with sides numbered one through six. It may be thought of as Craps with one die.

One of the most ancient of games, Craps is a favorite of many casino patrons. Perhaps the main reason is that the casino's percentage is lower for Craps than for any other table game. The popularity of Craps has led many an inventor to try to improve or change this best of games. Their attempts have often made a complicated game even more complicated.

An example of such a game in the prior art is the patent issued to Stewart (U.S. Pat. No. 5,542,671, Aug. 6, 1996). This game involves three dice, one red and two white. Players are paid depending on a complicated formula based on the value of the dice and whether the values are odd or even.

Another example of a game using dice is disclosed in Bonito's "Catalina Dice" (U.S. Pat. No. 5,931,471, Aug. 3, 1999). Craps is the basis for this game which uses only two dice. The field bet and various hardway bets are modified.

Though the many different betting strategies available to players of Craps make the game seem complicated, it is best to remember that there is one basic bet called the Pass Line. If a player bets the Pass Line, he or she wins if the shooter rolls a seven or eleven on the first roll. The player loses if the shooter rolls a two, three, or twelve on the first roll. If the shooter rolls any other number that number becomes the point and the shooter must try to roll the point again in subsequent rolls. If the shooter rolls the point before seven, the player wins. If the shooter rolls seven before he rolls the point, the player loses. This represents the basic Pass Line bet. Though there are many other bets available to Craps players, the present invention is related only to the Pass Line bet and certain hopping or one-roll bets.

SUMMARY OF INVENTION

The present invention describes a game wherein players are seated at a table similar to a Blackjack table. The table has areas denoting numbers one through six. It has spaces for a dice cup and a point marker. There is a plurality of betting circles.

After players have placed their initial bets, the dealer shakes the die (first roll). One loses, six wins, and any other number becomes the point. If there is a point, the dealer places the point marker on the corresponding area. The dealer then shakes the die again (second roll). One loses and the point wins, and the game starts over. Any other number means no action and the dealer shakes the die again (third roll). Again it is one loses and the point wins, start over; otherwise the dealer shakes the die the last time (fourth roll). The player wins only if the point is rolled, else he forfeits his bet.

Players may also bet on the outcome of any individual roll.

The simplicity, quick pace, various odds and payouts, along with the fact that dice will not have to be chased through the casino, should entertain gamblers; which is the objective of this game.

DETAILED DESCRIPTION

Figure 1:
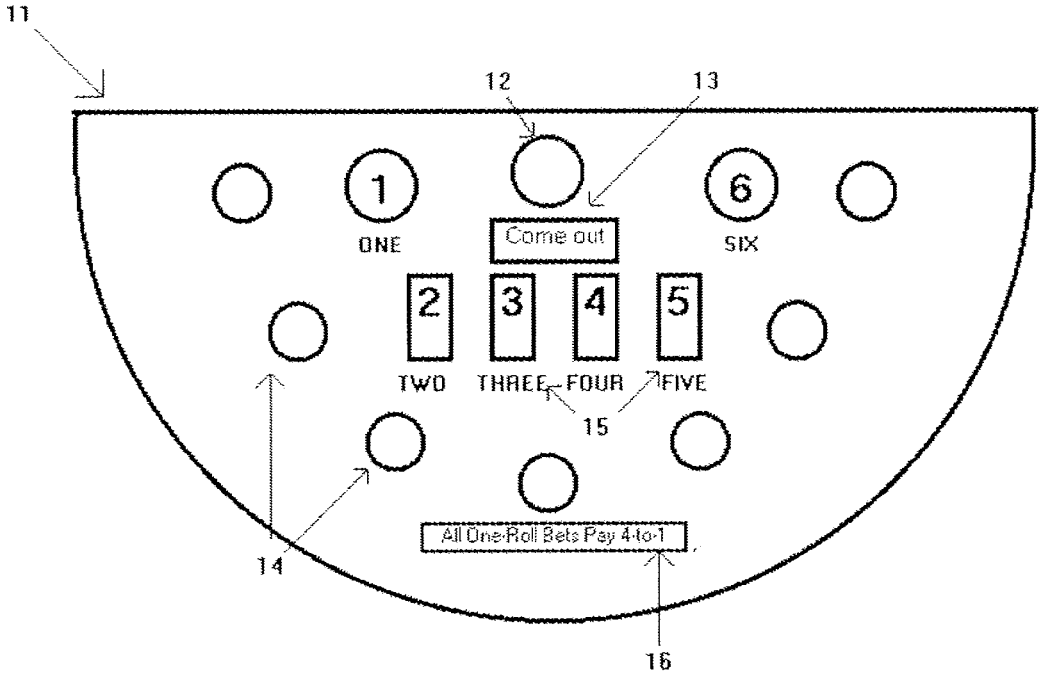
FIG. 1 represents the table top of the game disclosed here.
Figure 2:
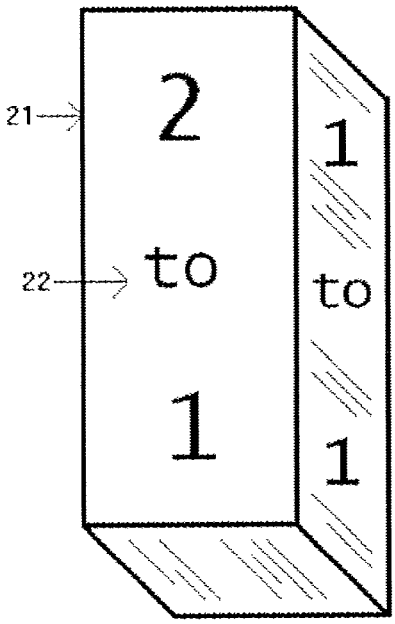
FIG. 2 is a perspective view of the point marker.
Figure 3:
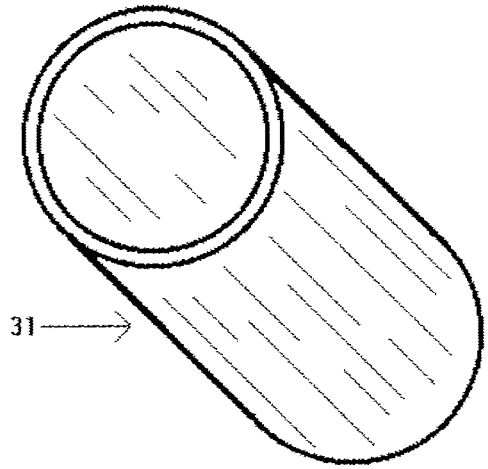
FIG. 3 is a perspective view of the dice cup.
Figure 4:
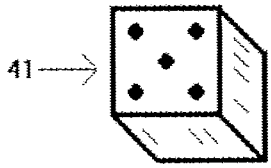
FIG. 4 is a perspective view of the die.

The preferred embodiment of the present invention will now be described in detail. It will be understood, however, that there is no intention to limit the invention to the particular form disclosed. All variations and alternative constructions including, for example, four rolls to make the point are likewise within the scope of this invention. The invention may also be embodied in computerized form.

With reference to all drawings, the game begins when players seated around the gaming table layout 11 place their first bets on betting circles 14, prior to the first roll of the die 41. Also, before this or any roll of the die 41, a player may make a second bet on the outcome of the next roll. So-called hopping bets are placed next to the number that is bet.

The dealer then takes the dice cup 31 which is kept in the dice cup position 12, he shakes the dice cup 31 several times, replaces it in the dice cup position 12, and then exposes the die 41. If the outcome is one, the players lose their first bets. If the outcome is six, the players win their first bets. If the outcome is any other number, 2, 3, 4, or 5, then the dealer places the point marker 21 which has been kept in the point marker's base position 13 on the appropriate point box 15 depending on what number was rolled. The dealer should be careful to always place the point marker 21 in such a way that the odds of rolling the point on the first opportunity are in the uppermost position. In the preferred embodiment the stated odds 22 are two-to-one. The dealer may also announce the point number.

The dealer should take care of all second bets after each roll. Second bets win if the number which is bet upon is rolled on that roll, otherwise they lose. Winning second bets are paid the stated odds 16 of four-to-one. The dealer should allow time for more one-roll bets after each roll.

If there was no point established on the first roll, then the game starts over and the same rules apply: One loses and six wins, otherwise a point will be established.

After there is a point, the dealer shakes and exposes the die 41 for a second time. If the point is rolled on this, the first opportunity, then each player's first bet is paid odds of two-to-one. If a one is rolled each player's first bet is forfeited. If the point or a one is rolled and the dealer has paid or taken the bets as required, he is then to place the point marker 21 on the point marker's base position 13 to indicate the start of a new game and a new round of betting. Any other number besides a one or the point means there is no action on the player's first bet. The dealer will leave the point marker 21 on the same point box 15 and turn it so that the odds for making the point on the next roll is uppermost. In the preferred embodiment, those odds are one-to-one.

If the point was not rolled the dealer shakes and exposes the die 41 again. If the point is rolled now, the second opportunity, then each player's first bet is paid odds of one-to-one. If a one is rolled each player's first bet is forfeited. If the point or a one is rolled and the dealer has paid or taken the bets as required, he is then to place the point marker 21 on the point marker's base position 13 to indicate the start of a new game and a new round of betting. Any other number besides a one or the point means there is no action on the player's first bet. The dealer will turn the point marker 21 again so that the odds of making the point on the next roll are uppermost. In the preferred embodiment, those odds are one-to-one.

In the preferred embodiment, the dealer will then roll the die 41 for the last time. If the point is rolled on this last opportunity, each player's first bet is paid one-to-one. Otherwise each player's first bet is forfeited. In either case, the dealer places the point marker 21 on the point marker's base position 13 to indicate the start of a new game and a new round of betting.

Other preferred embodiments of the present invention include changing the number of rolls to achieve the point to four, and changing the odds.

What is claimed is:

1. A method of playing a game with one die, a dice cup, a point marker, and a game board; involving a dealer and one or more players; the method comprising the steps of:

(a) a player making a first bet means, (b) the dealer shaking and exposing the die and, if the value is one each player forfeits his first bet, if the value is six the dealer pays each player the amount of his first bet, and if the value is any other number the dealer moves the point marker to the corresponding position for said number so that the point marker shows the odds for said number to be repeated on the next roll. Said number is called the point, (c) the dealer shaking and exposing the die and, if the value is one each player forfeits his first bet, if the value is the point the dealer pays each player's first bet the odds stated on the point marker, and if the value is any other number the dealer turns the point marker to show the odds for the point to be repeated on the next roll, (d) the dealer shaking and exposing the die and, if the value is one each player forfeits his first bet, if the value is the point the dealer pays each player's first bet the odds stated on the point marker, and if the value is any other number the dealer turns the point Marker to show the odds for the point to be repeated on the next roll, (e) the dealer shaking and exposing the die and, if the value is the point the dealer pays each player's first bet the odds stated on the point marker, and if the value is any other number each player forfeits his first bet, (f) a player making a second bet means (g) a second bet made by a player is a bet on the next roll of the die betting that the value of the die is 1, 2, 3, 4 5, or 6.

2. The method of claim 1 wherein the point marker is in the point marker's base position at the start the game.

3. The method of claim 1 wherein after the point is established, if the point or a one is rolled, then the game is over and the point marker is returned to the point marker's base position.

4. The method of claim 1 wherein if the point is not rolled in three attempts, then the game is over and the point marker is returned to the point marker's base position.

* * * * *